United States Patent [19]

Clune et al.

[11] 3,968,396

[45] July 6, 1976

[54] SELF BALLASTED LAMP INCLUDING A FUSEABLE DEVICE

[75] Inventors: James P. Clune, Danvers; Robyn N. Frost, Lynn, both of Mass.

[73] Assignee: International Telephone and Telegraph Corporation, Nutley, N.J.

[22] Filed: May 23, 1974

[21] Appl. No.: 472,576

Related U.S. Application Data

[63] Continuation of Ser. No. 385,923, Aug. 6, 1973, abandoned.

[52] U.S. Cl. ..... 315/74; 315/49; 315/119; 315/125; 315/127; 316/17; 316/24; 316/32

[51] Int. Cl.[2] ..... H01J 7/44; H05B 37/00; H01J 9/46

[58] Field of Search ..... 315/47, 49, 72, 74, 315/75, 119, 123, 125, 127; 316/17, 24, 26, 30–32

[56] References Cited

UNITED STATES PATENTS

| | | | |
|---|---|---|---|
| 1,616,431 | 2/1927 | Rentschler | 316/32 |
| 2,329,626 | 9/1943 | Krefft et al. | 315/49 |
| 2,671,873 | 3/1954 | Meier | 316/24 |
| 3,285,293 | 11/1966 | Matheson | 140/71.5 |
| 3,817,591 | 6/1974 | Deiss | 316/19 |

*Primary Examiner*—Stanley D. Miller, Jr.
*Attorney, Agent, or Firm*—John T. O'Halloran; Richard A. Menelly

[57] ABSTRACT

A filament coil is connected in series with an arc tube to form a self ballasted lamp. An internal starting coil is connected across the arc tube through a bimetal switch, which is normally closed, for energizing the starting coil. When an arc is struck and the tube temperature rises, the bimetal switch opens to cut out the starting coil. A fuse wire is connected across the bimetal switch to facilitate flashing of the filament coil by application of less than rated voltage during evacuation of the lamp envelope when the bimetal switch is normally open because of the elevated temperatures required for glass working and sealing. Upon subsequent application of rated voltage, the fuse wire melts and the lamp operates in its normal manner.

15 Claims, 2 Drawing Figures

SELF BALLASTED LAMP INCLUDING A FUSEABLE DEVICE

This is a continuation of application Ser. No. 385,923, filed Aug. 6, 1973, now abandoned.

BACKGROUND OF THE INVENTION

1. FIELD OF THE INVENTION

The present invention relates to self ballasted lamps and more particularly to a self ballasted lamp that may be flashed during evacuation.

2. DESCRIPTION OF THE PRIOR ART

Heretofore, 160 watt, incandescent parabolic arc reflector lamps had a rated life of 2,000 hours. These lamps utilized a conventional tungsten incandescent filament for providing illumination.

During the manufacture of these lamps, the filaments were energized to incandescent temperatures by the application of increased voltage steps while the lamp was evacuated on an exhaust machine. The purpose of this procedure was to clean the filament and mounting structure and for flashing the filament to a non-sag structure thereby stabilizing the filament. During the initial application of power to the filament, tungsten oxides and other contaminates were vaporized and removed by the exhaust machine. The initial flashing also served to stabilize the filament by forming a large interlocking grain structure in the tungsten which is referred to as a non-sag type of structure.

In an attempt to develope a self ballasted lamp having longer life and improved lumen maintenance, an incandescent filament coil was connected in series with a mercury vapor discharge tube to form a self ballasted lamp. The arc tube included a starter coil which was connected across the arc tube for energization through a bimetallic switch which opened after the arc was struck and the tube heated.

The manufacturing process for this type of lamp had to be modified because of the pressure of the bimetal switch which remained open at the high temperatures required for working and sealing the pyrex glass during the evacuation process. In the high temperature environment, the open bimetal switch prevented the application of intermediate voltage steps to the filament coil and the coil could not be flashed during evacuation of the lamp. Therefore, the coil was flashed after the lamp was removed from the exhaust machine and sealed. This subsequent flashing led to two undesirable results. The tungsten oxides and other contaminates on the filament and mounting structure vaporized and were deposited on the interior surface of the lamp forming a slightly opaque film which reduced the lumen output. In many instances, the vaporized contaminates provided an ion path across the lamp leads which caused the lamp to arc out upon initial lite-up at rated voltage. Thus, the lamps were subject to a short life with early failures, poor lumen maintenance and early blackening of the lamp lens.

SUMMARY OF THE INVENTION

The present invention contemplates a self ballasted lamp having an incandescent filament connected in series with a mercury vapor discharge lamp. The starter coil of the arc tube is energized through the incandescent filament and a bimetal switch which opens after the arc is struck and the tube heats up. In order to facilitate flashing of the filament during evacuation of the lamp envelope, when the bimetal switch is open because of the high temperature environment required for glass sealing, a fuse wire is connected across the bimetal switch to complete the coil circuit. Through the use of a fuse wire, intermediate voltage levels may be applied to the filament during the evacuation process so that the filament may be flashed and the vaporized contaminates removed by the exhaust machine. The fuse wire is selected so that it will melt when the rated voltage of the lamp is applied thereto either at the place of manufacture or subsequently by a consumer.

The primary objective of the present invention is to provide a self ballasted lamp that may be flashed during evacuation of the lamp envelope.

Another objective of the present invention is to provide a self ballasted lamp having increased average life and better lumen maintenance.

The foregoing and other objectives and advantages of the present invention will become more apparent from the following description and the accompanying drawings wherein one embodiment of the invention is described.

DESCRIPTION OF THE PREFERRED EMBODIMENT

Figure 1:
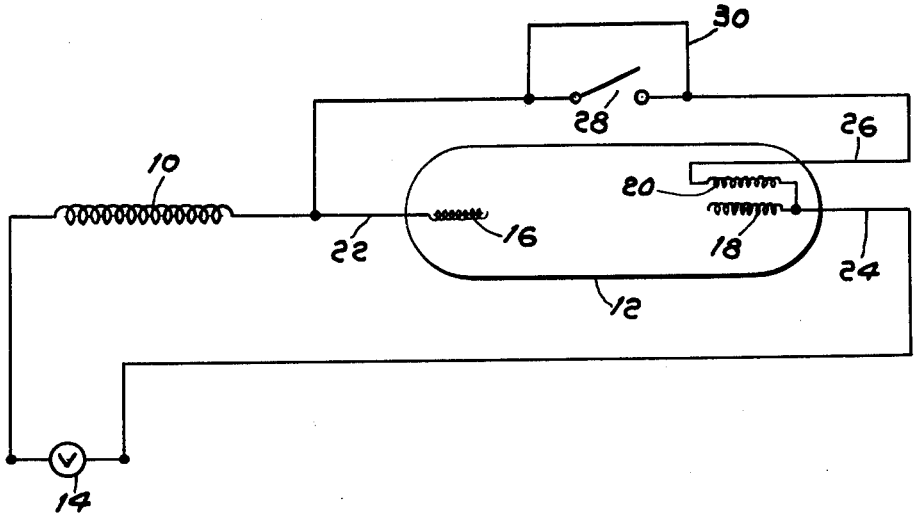
FIG. 1 is a schematic diagram of the circuit of the present invention.

Referring to FIG. 1, there is shown a schematic diagram of the present invention wherein an incandescent tungsten filament coil 10 is connected in series with a mercury vapor discharge tube 12. The series connection is adapted for connection to a voltage source 14. The tungsten filament 10 forms a ballast coil for the arc tube 12 and is selected to have a rating of approximately 70 watts at 93 volts. The arc tube 12 has a nominal rating of 80 watts and includes electrodes 16 and 18 at each end of the tube and a starter coil 20 positioned adjacent electrode 18. Arc tube 12 has a first lead wire 22 connected to electrode 16 and to one end of tungsten filament 10. A second lead wire 24 extends from arc tube 12 and is connected to electrode 18 and a first end of starter coil 20. A third lead wire 26 is connected to a second end of starter coil 20 and is also connected to lead wire 22 through a bimetal switch 28, which is selected to open at a temperature of approximately 150°F. A fuse wire 30 is connected across switch 28 and is selected to melt when approximately 97 volts are applied to the lamp. Preferably the fuse wire has a length of 10 millimeters and is formed of 5.45 mil steel mandrel wire which is preferred because it melts into beads rather than exploding at the fusing current.

Figure 2:
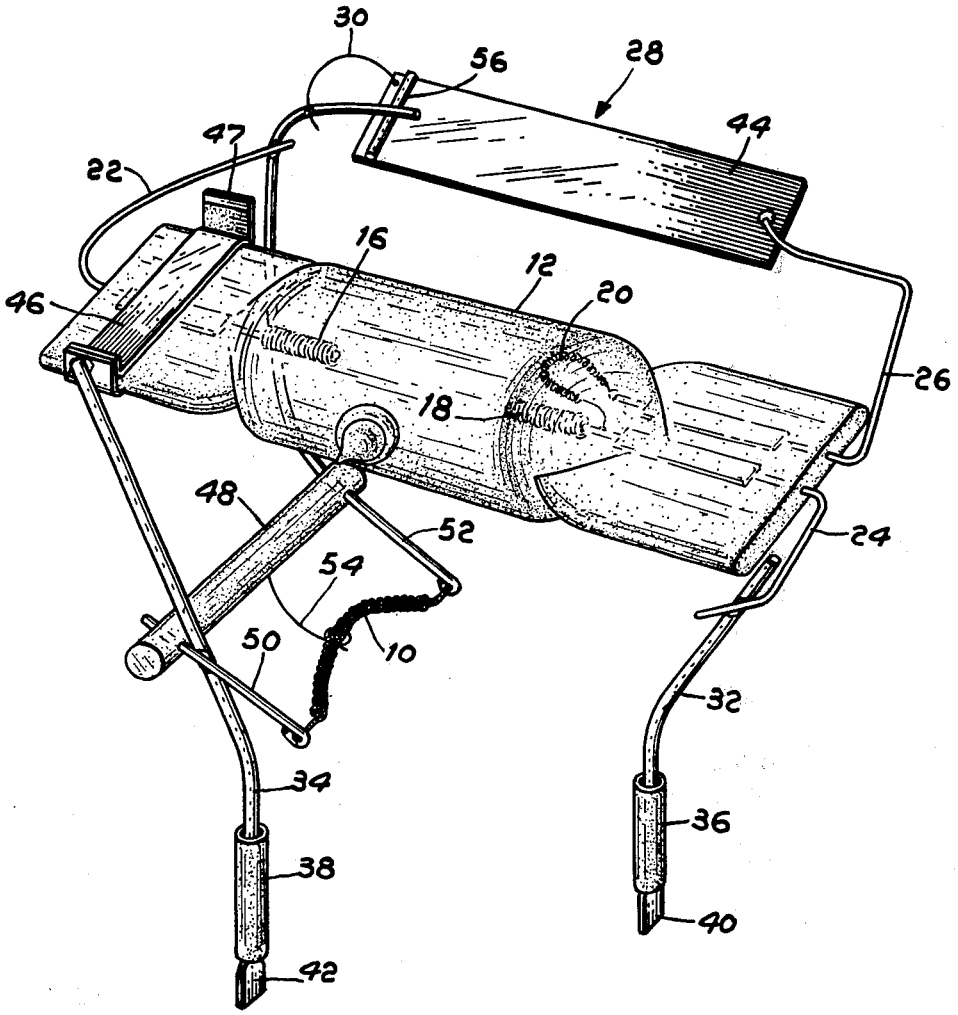
FIG. 2 is a perspective view showing the structural components of the present invention.

Referring to FIG. 2, there is shown a structural configuration of a lamp constructed in accordance with the present invention and which is designed to be mounted into a standard PAR38 lamp envelope. A PAR38 lamp envelope is a parabolic arc reflector envelope having an outside diameter of 38 eighths of an inch.

Lead mounts 32 and 34 are provided with pyrex sleeves 36 and 38 which are held in place by flattened end portions 40 and 42 of the lead mounts. The lead mounts may be formed of any suitable material but are preferably formed of nickel. The pyrex sleeves function to prevent arcking between the leads and between the leads and the interior lamp surface which has an aluminum coating. Lead mount 32 is connected to lead wire 24 extending from arc tube 12. A nickel ribbon 46 is secured to one end of arc tube 12 and is connected to lead mount 34 for supporting the arc tube. A zirconium getter 47 is strip welded to ribbon 46.

A glass support member 48 separates a pair of filament supports 50 and 52 between the ends of which is connected the tungsten filament 10. Glass support 48 has embedded therein a support wire 54 which engages a central portion of the tungsten filament 10 for providing additional support thereto. Filament support 50 is connected to lead mount 34 while filament support 52 is connected to lead wire 22 extending from arc tube 12. Lead wire 26 is welded to one end of a bimetal strip 44 which forms bimetal switch 28. Filament support 52 extends to a position adjacent a second end of bimetal strip 44 and is positioned to be engaged by a segment 56 of nickel wire welded to the second end of the bimetal strip. Segment 56 of nickel wire insures proper electrical contact with filament support 52 when the bimetal is exposed to a temperature below 150°F. Fuse wire 30 is welded between filament support 52 and the bimetal strip 44 for providing a temporary short across the bimetal switch.

During manufacture of the self ballasted lamp, the structure shown in FIG. 2 is mounted into a parabolic arc reflector type lamp base in a conventional manner and thereafter the lens is sealed to the base. The lamp is then mounted to an exhaust machine for evacuating the lamp envelope. The lamp is baked while on the exhaust machine at a temperature of 1020°F and after baking, but while still on the exhaust machine, and still at elevated temperatures, a voltage is applied to the lamp in five volt steps up to a maximum of 85 volts. During the application of this voltage, the filament and support members are cleaned and the coil is stabilized by flashing the filament to a non-sag structure. The tungsten oxides and other contaminates on the filament and support members are vaporized during the flashing process and are removed from the lamp envelope by the exhaust machine. The vaporized contaminates are not allowed to accumulate and form an ion path nor are they allowed to form a film on the inner surface of the lens. Thus, two major problems have been eliminated by flashing the filament during evacuation.

After flashing the filament by applying 85 volts to the lamp, the fuse may be caused to melt by applying the rated voltage during evacuation. Alternatively, the lamp could be back filled with an inert gas such as argon and sealed leaving the fuse wire intact, in which case the fuse wire will melt when the lamp is first used by the consumer.

It is apparent that when the lamp is subjected to a temperature of 1020°F, the bimetal switch will be in an open position and without the fuse wire the filament coil would be open circuited and could not be flashed. By providing a fuse wire that melts when a voltage of 97 volts is applied to the lamp the filament may be adequately flashed during evacuation by applying increased voltage steps up to a maximum of 85 volts. Upon the subsequent application of rated voltage, i.e. 120 volts, the fuse wire melts and no longer effects the operation of the lamp.

The present invention provides a self ballasted lamp that has an increased average life span and better lumen maintenance than was heretofore available. Through the unique use of a fuse wire connected across the bimetal switch, the tungsten filament may be flashed while the lamp is being evacuated so that vaporized contaminates are removed from the lamp.

Thus, the contaminates are not deposited on the lamp lens and the lumen output is not reduced. The removal of the vaporized contaminates by the exhaust machine also eliminates the possibility of developing an ion path between the lamp leads and the resultant arcking out of the lamp upon initial lighting.

While the principles of the invention have been described in connection with a specific structure, it is to be clearly understood that this description is made only by way of example and not as a limitation to the scope of the invention as set forth in the objects thereof and in the accompanying claims.

We claim:

1. A self ballasted lamp, comprising:

an arc tube of the type having a pair of electrodes and a starting coil;

a filament coil connected in series with said arc tube, said filament coil forming a ballast for the arc tube;

a temperature responsive switch connecting the starting coil in series with the filament coil at temperatures below a predetermined level; and a fuseable conducting element connected across the temperature responsive switch, wherein said fuseable element provides a series connection between the filament coil and the starting coil until the element is melted and separated by the application of a predetermined voltage to said lamp.

2. A self ballasted lamp as described in claim 1, in which the predetermined voltage at which the element fuses is less than rated voltage of the lamp.

3. A self ballasted lamp as described in claim 1, in which the fuseable element comprises a fuse wire.

4. A self ballasted lamp as described in claim 1, in which the fuseable element melts when approximately 97 volts are applied to the lamp.

5. A self ballasted lamp as described in claim 3, in which the fuse wire comprises steel mandrel wire.

6. A self ballasted lamp as described in claim 5, wherein the steel mandrel wire has a thickness of 5.45 mils.

7. A self ballasted lamp as described in claim 1, in which the temperature responsive switch comprises a bimetal.

8. A self ballasted lamp as described in claim 1, in which the temperature responsive switch opens at approximately 150°F.

9. A self ballasted lamp as described in claim 1, in which the arc tube is a mercury vapor lamp.

10. A self ballasted lamp as described in claim 1, in which the filament coil is formed of tungsten.

11. A method for processing a self-ballasted lamp of the type having an arc discharge tube and a resistive filament mounted within the lamp envelope and including a temperature responsive switch in series with said resistive filament comprising the steps of:

a. connecting a fusible conducting element across said temperature responsive switch for providing a series connection between said filament coil during lamp processing; and b. causing said fusible conducting element to melt by the application of a sufficient voltage to said filament coil.

12. A method for processing a self-ballasted lamp of the type having an arc discharge tube and a filament coil within the lamp envelope and including a temperature responsive switch connected between one of the arc electrodes and a starter coil comprising the steps of:

a. electrically connecting a fusible conducting element across the temperature responsive switch for providing electrical connection between the filament coil and the starter coil during lamp processing;

b. applying a first voltage value to said filament coil and said starter coil to flash said filament coil during lamp processing; and c. applying a second voltage to said filament coil and said starter coil to melt the fusible conducting element to break the electric connection between said filament coil and said starter coil.

13. The method of processing a self-ballasted lamp according to claim 12 wherein said second voltage is greater than said first voltage.

14. A method for processing a self-ballasted lamp comprising the steps of:

a. coupling an arc discharge tube between a pair of first and second lead members, said discharge tube having a pair of first and second opposing electrodes therein and a starter coil proximate to said second electrode;

b. electrically connecting a resistive filament ballast between said first lead member and said first electrode for limiting the lamp current during operation;

c. electrically connecting said first electrode to said starter coil by means of a temperature responsive switch;

d. electrically connecting a fusible conducting element across said temperature responsive switch for providing a series connection between said filament coil and said starter coil during lamp processing;

e. electrically connecting said second electrode to said second lead member to provide input power to said lamp in cooperation with said first lead member;

f. sealing said lead wires containing said filament coil, said discharge arc tube, said fusible conducting element, and said temperature responsive switch within a lamp envelope;

g. heating and evacuating said envelope;

h. applying voltage to said pair of lead wires for heating both said filament coil and said starter electrode;

i. increasing said voltage to a value sufficient to melt said fusible conducting element;

j. filling said lamp envelope with an inert gas; and k. sealing said lamp envelope.

15. A mount structure for use with self-ballasted lamps of the type having an arc discharge tube, a filament coil and a temperature responsive switch contained within a lamp envelope comprising in combination:

a. a pair of first and second lead support members for providing input power to the lamp;

b. an arc tube having a pair of first and second electrodes and a starter coil contained therein, wherein the first lead support member is coupled with said first electrode;

c. a filament coil serially coupled with said second lamp electrode for limiting the lamp voltage;

d. a temperature responsive switch electrically coupled between the starter coil and said second electrode for providing electrical connection therewith when said switch is in a closed position; and e. a fusible conducting element coupled across said temperature responsive switch for providing electrical continuity between said starter coil and said tungsten filament when said temperature responsive switch is in an open position.

* * * * *